US005501092A

United States Patent [19]

Miyazawa et al.

[11] Patent Number: 5,501,092

[45] Date of Patent: Mar. 26, 1996

[54] DIE-PUNCH MACHINE

[75] Inventors: Toshiki Miyazawa; Masahide Sakaguchi, both of Tokyo, Japan

[73] Assignee: Hidaka Seiki Kabushiki Kaisha, Tokyo, Japan

[21] Appl. No.: 273,824

[22] Filed: Jul. 12, 1994

[30] Foreign Application Priority Data

Jul. 14, 1993 [JP] Japan ..... 5-173536
Oct. 18, 1993 [JP] Japan ..... 5-259740

[51] Int. Cl.[6] ..... B21D 37/18; B21J 13/14

[52] U.S. Cl. ..... 72/43; 72/344; 72/328; 72/335

[58] Field of Search ..... 72/333, 335, 328, 72/344, 347, 43–45, 354.6, 355.4, 359

[56] References Cited

U.S. PATENT DOCUMENTS

| | | | |
|---|---|---|---|
| 2,378,068 | 6/1945 | Eason | 72/45 |
| 3,733,873 | 5/1973 | Ballmer | 72/45 |
| 4,094,182 | 6/1978 | Kusada | 72/344 |
| 4,674,314 | 6/1987 | McGregor | 72/355.4 |
| 4,882,924 | 11/1989 | Kohama | 72/344 |
| 5,159,826 | 11/1992 | Miyazawa et al. | 72/335 |
| 5,237,849 | 8/1993 | Miyazawa | 72/335 |

FOREIGN PATENT DOCUMENTS

| | | | |
|---|---|---|---|
| 1163941 | 6/1985 | U.S.S.R. | 72/44 |
| 1407619 | 7/1988 | U.S.S.R. | 72/45 |

*Primary Examiner*—Daniel C. Crane

[57] ABSTRACT

A die-punch machine capable of directly supplying a machining oil to an end section of a punch and to a workpiece to be machined. A first member holds the punch, and a second member is capable of relatively moving to and away from the first member. A die is held by the second member, wherein a front end section of the punch is capable of inserting into the die. A stripper plate provided between the first member and the second member, is connected to the first member, and has a clearance thereto and a through-hole, wherein the clearance is shortened. The front end section of the punch projects from a face of the stripper plate, which is on the second member side, through the through-hole so as to go into the die when the first member and the second member mutually get close. An oil path for introducing machine oil is formed in the stripper plate, one end of the oil path is opened on an inner face of the through-hole.

22 Claims, 7 Drawing Sheets

DIE-PUNCH MACHINE

BACKGROUND OF THE INVENTION

1. Field of the Invention

The present invention relates to a die-punch machine, more precisely relates to a die-punch machine for press-machining works, e.g., metal plates, which comprises: a punch; a first member for holding the punch; a second member being capable of relatively moving to and away from the first member; and a die being held by the second member, wherein a front end section of the punch is capable of being inserted into the die.

2. Description of Background Art

Conventionally, for example, radiating fins of heat exchangers, which are used in room or car air conditioners, are manufactured by press-machining processes. One of the processes is disclosed in U.S. Pat. No. 5,237,849. The process shown in the U.S. patent will be explained with reference to FIGS. 9A–9F.

Firstly, a cone section 2 is formed in a metal plate 1 (FIG. 9A). A flat section 4 is formed by extending a thin top portion of the conical section 2, then a truncated cone section 3 (FIG. 9B). A hole 6 is bored in the flat section 4 of the truncated cone section 3, and the hole 6 is bored so as to form a projected section 7 on an edge of the hole 6 (FIG. 9C). Then the projected section 7 is ironed to form a collar 8 (and 9) having prescribed height (FIGS. 9D and 9E). Finally, a top edge of the collar 8 is bent outward to form a flange section 10 (FIG. 9F).

The above described press-machining steps 9A–9F can be executed by a conventional die-punch machine shown in FIG. 10. In the die-punch machine, a metal plate 1, which has been fed in a direction of an arrow A, is intermittently moved. While being intermittently, the metal plate 1 is passed through machining stages 102, 104, 106, 108 and 110, each of which has an upper member held by an upper base board 100 and a lower member held by a lower base board 200, in order, and finally discharged in a direction of an arrow B.

The step shown in FIG. 9A is executed in the stage 102; the step shown in FIG. 9B is executed in the stage 104; the step shown in FIG. 9C is executed in the stage 106; the steps shown in FIGS. 9D and 9E are executed in the stage 108; and the step shown in FIG. 9F is executed in the stage 110.

Each stage has a proper punch and a proper die for the machining step assigned thereto. A partial sectional view of the stage 108 for the steps shown in FIGS. 9D and 9E is shown in FIG. 11.

The stage 108 has an upper member 300 and a lower member 400. In the upper member 300, a die 116 is held by plates 112 and 114.

A lower end of the die 116 is slightly projected downward from a bottom face of the plate 114 of the upper member 300. A knock-out 118, which is an example of an ejecting member, is inserted in the die 116. The knock-out 118 is always biased toward the lower member 400 by a spring 120. Upon completing the ironing step by inserting a punch 128 in the die 116, the knock-out 118 is moved downward together with the punch 128. By the downward movement of the knock-out 118, the collar 8 (and 9), which has been stuck on an inner face of the die 116, is ejected from the die 116.

A columnar member 132 is inserted in a cylindrical member 126, which is fixed by plates 122 and 124 of the lower member 400. By inserting the columnar member 132, an upper end of the punch 128 is fixed and projects from the cylindrical member 126.

The diameter of the upper end section 138 of the punch 128 is smaller than the diameter of a mid-section thereof. There is formed a tapered section 136 immediately below the upper end section 138.

A stripper plate 130 is provided in the lower member 400. The stripper plate 130 is always biased toward the upper member 300 by a biasing member 131, so that there is formed a clearance between the stripper plate 130 and the plate 122. A through-hole 134 is bored therein through which the upper end section of the punch 128 can be passed in a stripper plate 130. The height of the stripper plate 130 is adjusted so as to not project from the upper end of the punch 128 from an upper face of the stripper plate 130 when no downward force works on the stripper plate 130. The metal plate 1 having the projected section 7 (see FIG. 9C) is mounted on the upper face of the stripper plate 130, and the ironing steps shown in FIGS. 9D and 9E are executed.

When the ironing steps are executed, the upper member 300 is moved downward, so that the lower end face of the die 116 pushes the stripper plate 130 downward. By the downward movement of the stripper plate 130, the distance between the stripper plate 130 and the plate 122 is shortened. Then the upper end section of the punch 128 goes into the through-hole 134 and projects from the upper face of the stripper plate 130. When the upper member 300 is further moved downward, the upper end section of the punch 128 goes into the die 116 and pushes the knock-out 118 upward against the elasticity of the spring 120. With the movement of the die 116, the projected section 7 is ironed by the punch 128 and the inner face of the die 116. The ironing is completed when the tapered section 136 of the punch 128 passes through the projected section 7 (see FIG. 12).

Upon completing the ironing, the upper member 300 is moved upward, and the upper end section of the punch 128 comes off from the die 116. With the movement, the knock-out 118, which is contacted the punch 128 by the elasticity of the spring 120, is moved downward, so that the collars 8 (9) stuck on the inner face of the die 116 is ejected downward.

The conventional die-punch machine shown in FIG. 10 has the stages 102, 104, 106 and 110, each of which has a proper die and a proper punch, besides the stage 108 shown in FIG. 11. By feeding the metal plate 1 in the direction of the arrows A and B, the collared through-holes can be formed in the metal plate 1.

In the conventional die-punch machine shown in FIG. 10, machining oil is supplied to the metal plate 1 so as to raise the efficiency of the press machining. Volatile oils are preferably used as machining oils but they volatilize in a short time. Thus, even if they are supplied before the metal plate 1 is fed, almost volatile oil will volatilize before the metal plate 1 is passed all stages. So practically the efficiency of the press machining cannot be raised.

To overcome the disadvantage, the inventors invented an improved die-punch machine, which has been disclosed in U.S. Pat. No. 5,159,826. The improved machine will be explained with reference to FIG. 13.

In a machine shown in FIG. 13, oil paths 138 and 140 are formed in the punch 128, the columnar member 132 and the knock-out 118. By forming the oil paths 138 and 140, the machine oil can be supplied to the punch 128 and the metal plate 1. In each machining stage, the machining oil, which has been formed into a mist, is sprayed to the metal plate 1 on the stripper plate 130 when the press machining is executed. By spraying the oil mist, the metal plate 1, which is fully supplied with oil, is machined in each stage.

However, in the die-punch machine shown in FIG. 13, openings of the oil paths 138 and 140 are closed when the upper end face of the punch 128 contacts the lower end face of the knock-out 118, so that the oil mist cannot be sprayed. Namely, the machining oil cannot be supplied to the projecting section 7 to be machined while the ironing is executed.

The machining oil introduced through the oil paths 138 and 140 can be directly sprayed to the tapered section 136 of the punch 128 for ironing until the upper end face of the punch 128 contacts the lower end face of the knock-out 118. But the machining oil cannot be sprayed to the tapered section 136 after the upper end face of the punch 128 contacts the lower end face of the knock-out 118.

As described above, in the conventional die-punch machine, machining oils cannot be directly supplied to not only workpieces, e.g., the metal plate, to be machined but also front end sections of punches while the ironing work is executed. Thus, a large amount of machining oils must be supplied prior to the ironing work, and oil consumption must be increased.

SUMMARY OF THE INVENTION

An object of the present invention is to provide a die-punch machine, which is capable of directly supplying a machining oil to an end section of a punch and to a workpiece to be machined.

To achieve the object, a first basic structure of the die-punch machine comprises:

a punch;

a first member for holding the punch;

a second member being capable of relatively moving to and away from the first member;

a die being held by the second member, wherein a front end section of the punch is capable of being inserted into the die;

a stripper plate being provided between the first member and the second member, the stripper plate being connected to the first member, and having a clearance thereto and a through-hole, wherein the clearance is shortened, and the front end section of the punch projects from a face of the stripper plate, which is on the second member side, through the through-hole so as to go into the die when the first member and the second member mutually get close; and an oil path for introducing a machine oil being formed in the stripper plate, one end of the oil path being opened on an inner face of the through-hole.

A second basic structure comprises:

a punch;

a first member for holding said punch;

a second member being capable of relatively moving to and away from the first member;

a die being held by the second member, wherein a front end section of the punch is capable of inserting into the die;

an ejecting member for ejecting a workpiece, which is stuck on an inner face of the die, when the front end of the punch comes off from the die, an outer circumferential face of the ejecting member being capable of sliding on the inner face of the die, the ejecting member being capable of contacting the end face of the punch in the die whereby the ejecting member is moved with the movement of the punch; and an oil path for introducing a machine oil being formed in the ejecting member, one end of the oil path being opened on the outer circumferential face of the ejecting member.

A third basic structure comprises:

a punch;

a first member for holding the punch;

a second member being capable of relatively moving to and away from the first member;

a die being held by the second member, wherein a front end section of the punch is capable of being inserted into the die;

a stripper plate being provided between the first member and the second member, the stripper plate being connected to the first member, and having a clearance thereto and a through-hole, wherein the clearance is shortened, and the front end section of the punch projects from a face of the stripper plate, which is on the second member side, through the through-hole so as to go into the die when the first member and the second member mutually are adjacent to each other;

an ejecting member for ejecting a workpiece, which is stuck on an inner face of the die, when the front end of the punch comes off from the die, an outer circumferential face of the ejecting member being capable of sliding on the inner face of the die, the ejecting member being capable of contacting the end face of the punch in the die whereby the ejecting member is moved with the movement of the punch;

a first oil path for introducing machine oil being formed in the stripper plate, one end of the first oil path being opened on an inner face of the through-hole; and a second oil path for introducing machine oil being formed in the ejecting member, one end of the second oil path being opened on the outer circumferential face of the ejecting member.

In the die-punch machine having the first and the second basic structures, the machining oil can be supplied to a position or positions to which the machining oil must be supplied to raise the machining efficiency.

In the die-punch machine having the third structure, the machining oil can be simultaneously supplied in the through-hole from the first oil path in the stripper plate and the second oil path in the ejecting member. Therefore, the machining oil can be directly supplied to the punch while the ironing is executed, so that the machining efficiency can be further raised.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

In the present embodiments, the die-punch machine for manufacturing the radiating fins shown in FIGS. 9A–9F will be explained. The summarized structure of the die-punch machine is shown in FIG. 10. Its detailed structure has been described in "BACKGROUND OF THE INVENTION" so it will be omitted here.

Figure 9A:
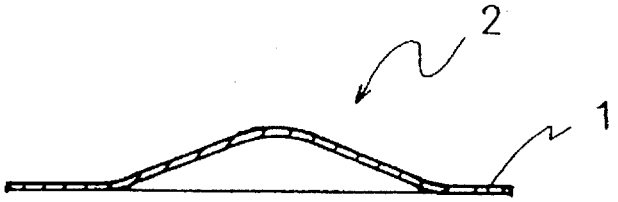
FIGS. 9A–9F are explanation views showing the ironing steps for manufacturing the radiating fins of air conditioners.
Figure 9B:
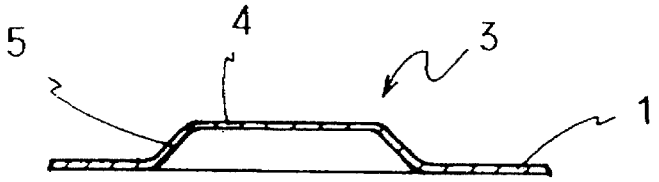
Figure 9C:
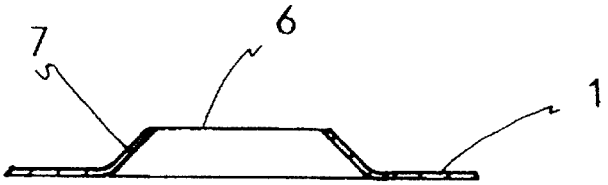
Figure 9D:
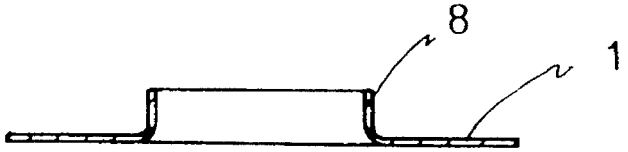
Figure 9E:
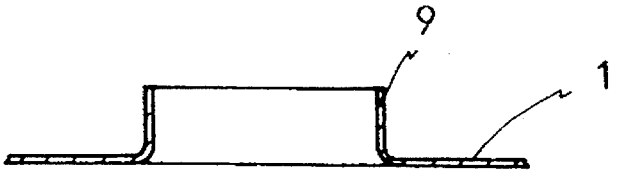
Figure 9F:
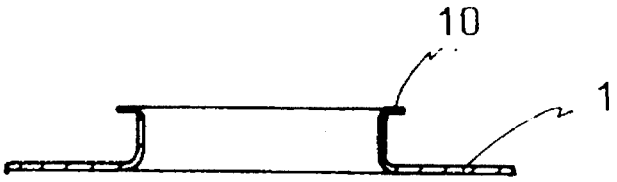
Figure 10:
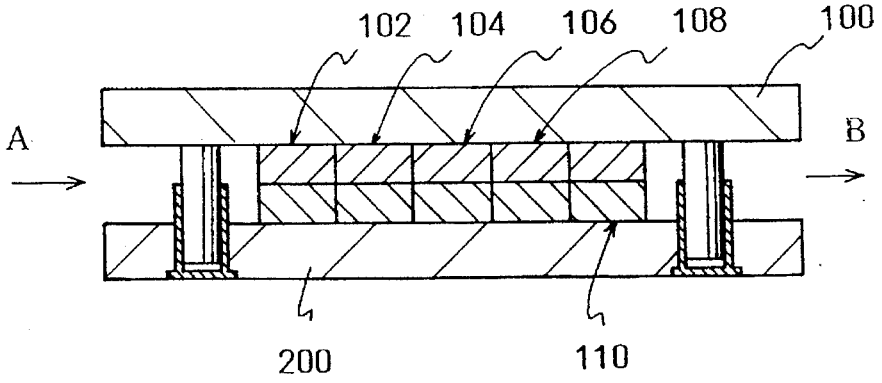
FIG. 10 is a view showing a summarized structure of a die-punch machine for manufacturing the radiating fins.
Figure 11:
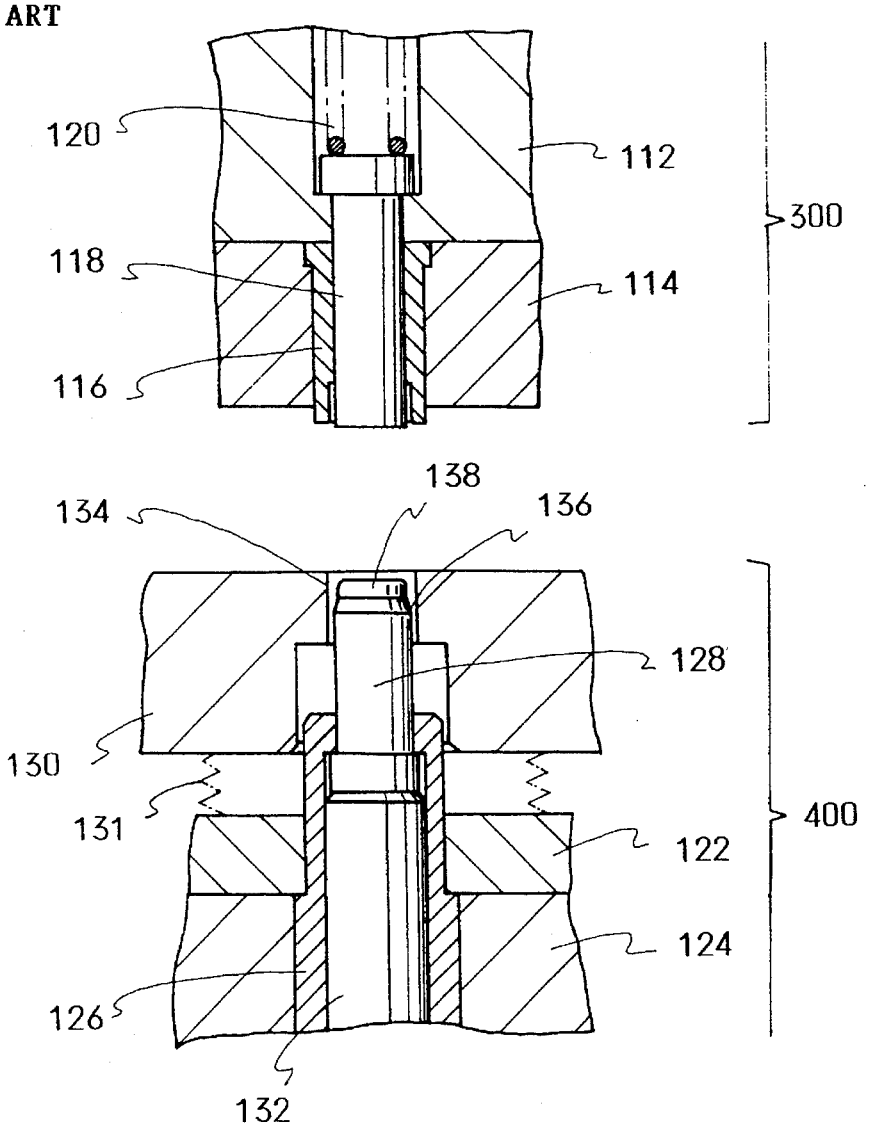
FIG.11 PRIOR ART
FIG. 11 is a longitudinal partial sectional view of the conventional ironing stage, which can be assembled in the machine shown in FIG. 10.

In FIG. 10, the ironing steps shown in FIGS. 9D and 9E are executed in the stage 108. The partial sectional view of the stage 108 is shown in FIG. 1.

Figure 1:
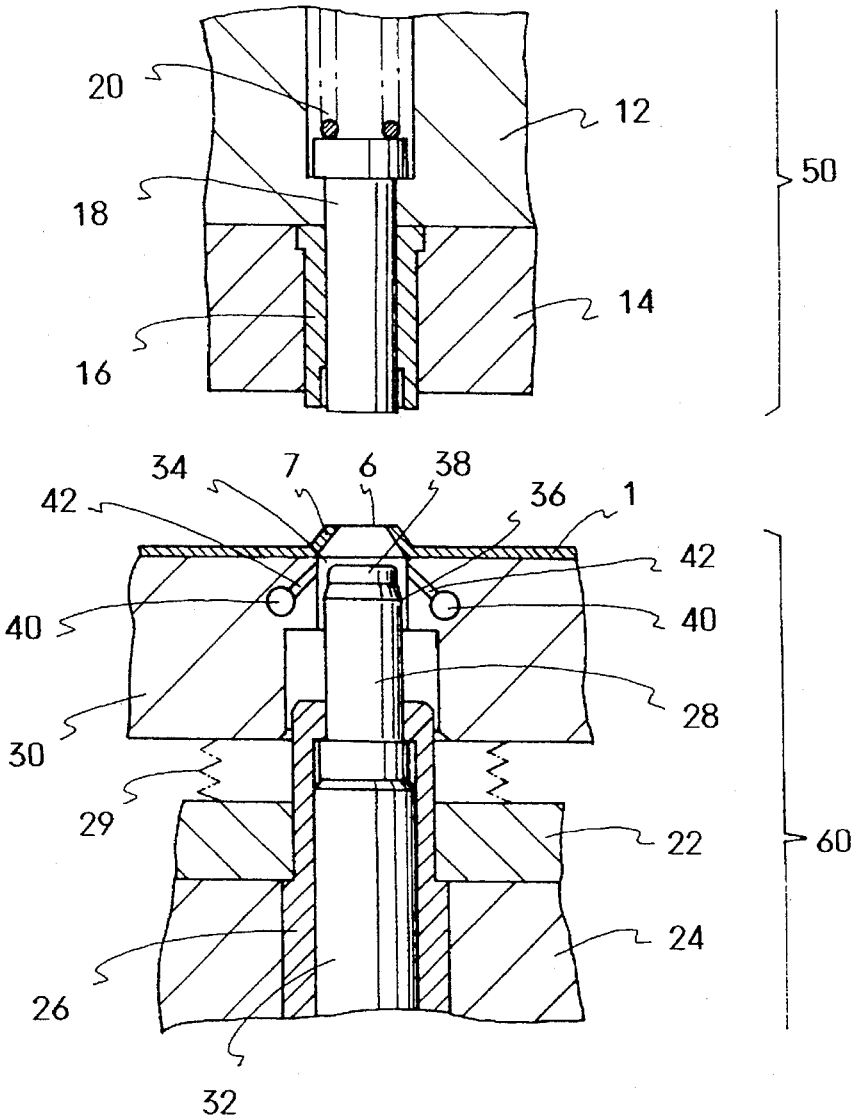
FIG. 1 is a longitudinal partial sectional view of one of ironing stage of a die-punch machine of an embodiment.

In FIG. 1, the stage 108 has a lower member (a first member) 60 and an upper member (a second member) 50. The upper member 50 has plates 12 and 14 for fixing a die 16. A lower end section of the die 16 slightly projects downwardly from a bottom face of the plate 14. A knock-out 18 is inserted in the die 16. The knock-out 18 is always biased downwardly by a spring 20.

The lower member 60 has plates 22 and 24. A cylindrical member 26 is fixed by the plates 22 and 24. A columnar member 32 is inserted in the cylindrical member 26. By inserting the columnar member 32, an upper end section of a punch 28, which is fixed to the lower member 60, projects from the cylindrical member 26.

The diameter of an end section 38 of the punch 38 is smaller than that of a mid-section thereof. Ironing action can be executed by a tapered section 36 of the punch 28.

The lower member 60 is connected to a stripper plate 30. The stripper plate 30 is always biased upward by a biasing member 29, so that there is formed a clearance between the stripper plate 30 and the plate 22 of the lower member 60. There is bored a through-hole 34 through which the upper end section of the punch 28 can be passed in the stripper plate 30. The height of the stripper plate 30 is adjusted to locate the upper end face of the punch 28 lower than an upper face of the stripper plate 30 when no downward force works on the stripper plate 30.

The metal plate 1 having the hole 6 and the projecting section 7 (see FIG. 9C) is mounted on the stripper plate 30 to execute the ironing steps shown in FIGS. 9D and 9E.

In the present embodiment, there are formed a couple of main (oil) paths 40 in the stripper plate 30. The main paths 40 are provided on both sides of the through-hole 34. There are formed sub (oil) paths 42 in the stripper plate 30, and they are branched off from each main path 40. Inner ends of the sub paths 42 are opened on an inner face of the through-hole 34. Machining oil, which is formed into an oil mist, is introduced into the main paths 40 and the sub paths 42, so that the oil mist is sprayed toward the upper end of the punch 28 via the sub paths 42. Note that, in the case shown in FIG. 2, a set of the oil path has one main path 40 and two sub paths 42.

Figure 2:
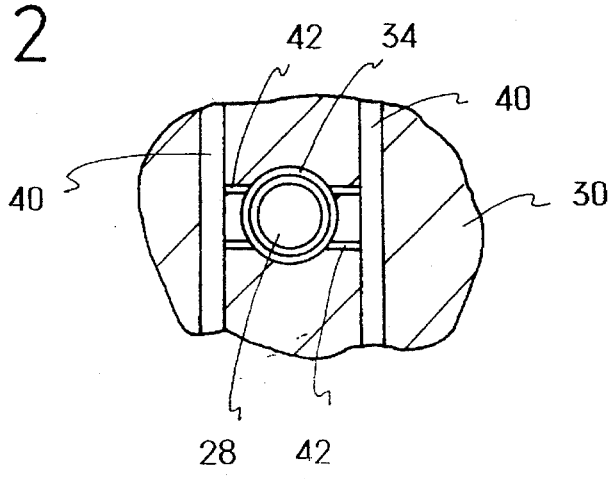
FIG. 2 is a partial sectional view of a stripper plate showing an oil path.

In the present embodiment, four sub paths 42 are formed between each main path 40 and the through-hole 34 (see FIG. 2). The inner ends of the sub paths 42 are faced to positions shifted from the center of the through-hole 34. Namely, the sub paths 42 are formed in the tangential directions with respect to the through-hole 34. Thus, the machining oil is spirally sprayed into the through-hole 34 from each sub path 42. By spirally spraying the machining oil, the machining oil can be supplied to the upper end section of the punch 28 and the projected section 7 of the metal plate 1. Note that, in FIG. 2, there are four sub paths 42 but the number of the sub paths 42 is not limited to four. It may be, for example, two and one.

Figure 3:
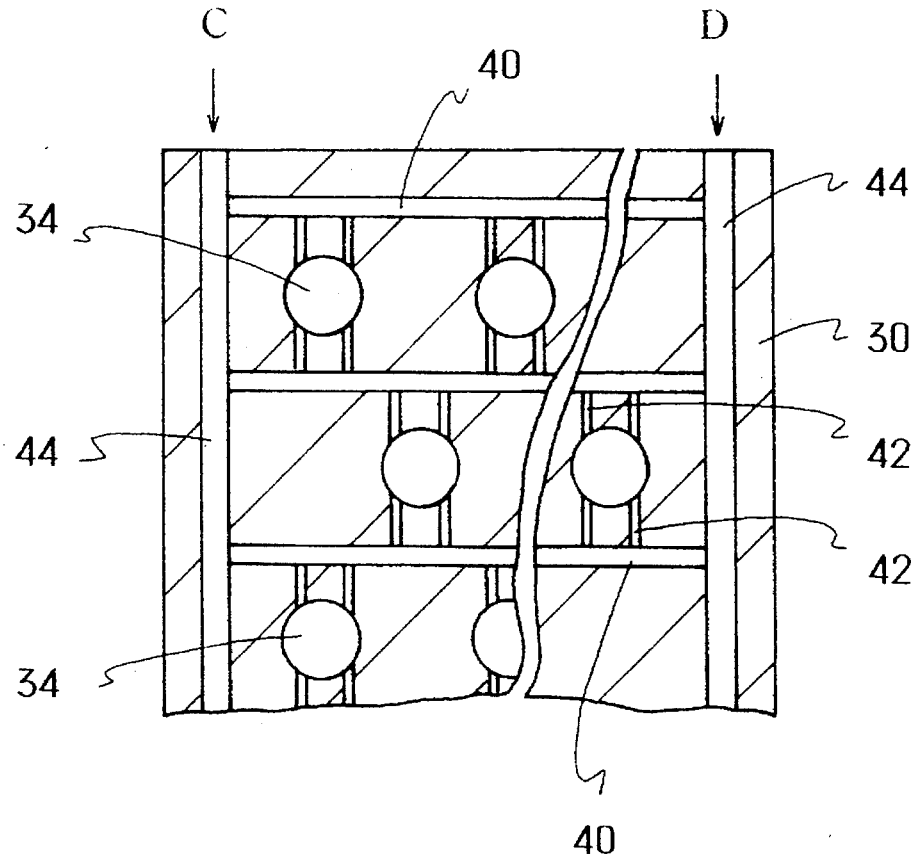
FIG. 3 is a partial sectional plan view of a stripper plate having a plurality of through-holes.
Figure 4:
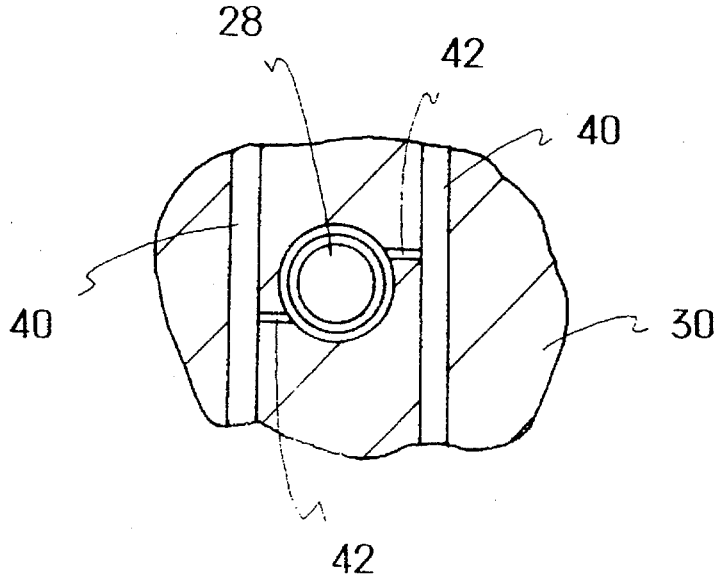
FIG. 4 is a partial sectional plan view of a stripper plate showing another example of the oil path.

Normally, a plurality of punches 28 are fixed to the lower member 60 of the stage 108. Thus, there are a plurality of through-holes 34 in the stripper plate 30. With a plurality of through-holes 34, the main paths 40 are connected to general oil paths 44, which are formed in both end sections of the stripper plate 40 (see FIG. 3). The through-holes 34 are respectively provided between the main paths 40, and two sub paths 42 connect the main path 40 and the through-hole 40.

The machining oil or the oil mist is introduced into the general paths 44 in directions of arrows C and D.

The stripper plate 30 is capable of vertically moving. Therefore, the oil mist is introduced into the general paths 44 via flexible tubes.

The projected section 7 of the metal plate 1, which has been mounted on the stripper plate 30, is ironed by the punch 28. During the ironing, the machining oil introduced into the main paths 40 is sprayed into the through-hole 34 via the sub paths 42 (see FIG. 1). By spraying, the machining oil can be directly sprayed to an inner part of the projected section 7 and the upper end section of the punch 28 including the tapered section 36.

In the state shown in FIG. 1, the stripper plate 30 is pushed downward when the upper member 50 is moved downward by the lower end face of the die 16. By the downward movement of the stripper plate 30, the distance between the stripper plate 30 and the plate 22 of the lower member 60 is shortened, so that the upper end section of the punch 28 projects from the upper face of the stripper plate 30. If the upper member 50 is further moved downward, the upper end section of the punch 28, which projects from the upper face of the stripper plate 30, passes through the through-hole 34. Thus, the punch 28 pushes the knock-out 18 upward against the elasticity of the spring 20. Then the upper end section of the punch 28 comes into the die 16 and irons the projected section 7 with the inner face of the die 16. The ironing is executed until the tapered section 36 of the punch 28 passes the projecting section 7.

In the present embodiment, the machining oil sprayed from the sub paths 42 can be directly supplied to the punch 28 while the ironing is executed, so that the machining efficiency can be raised.

Figure 5:
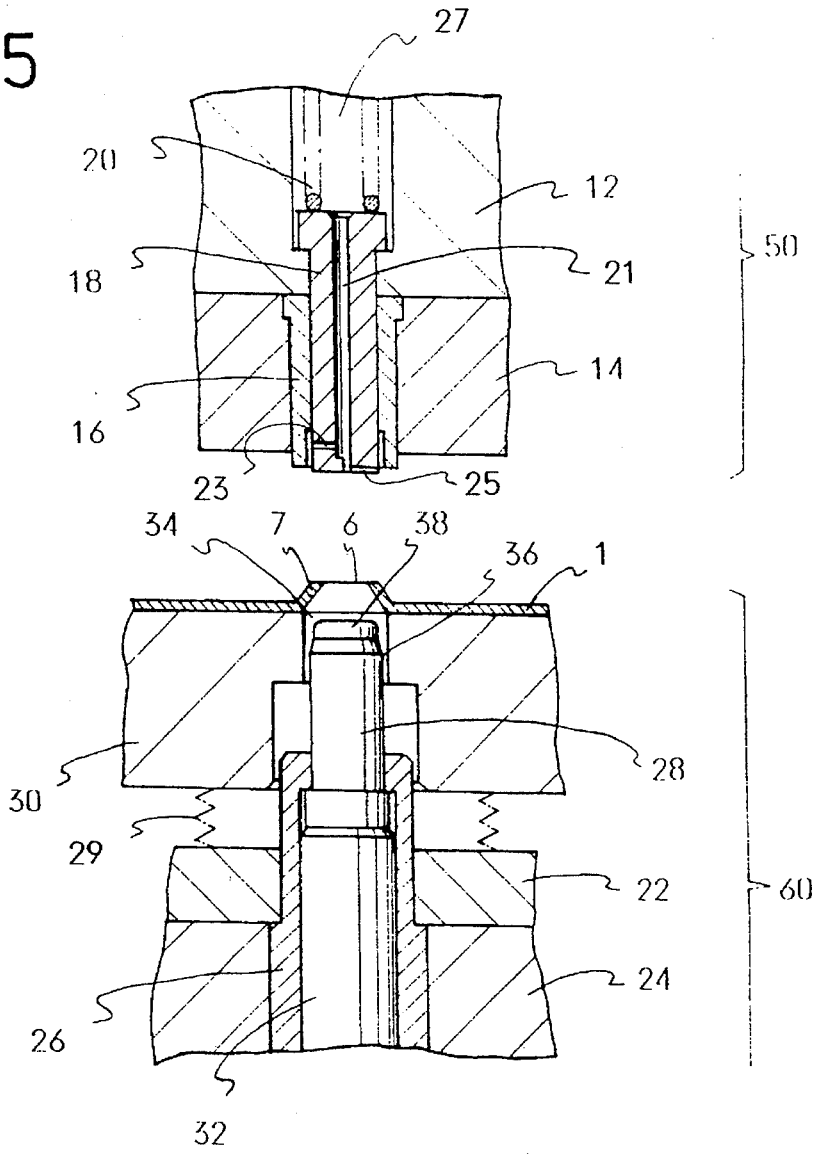
FIG. 5 is a longitudinal partial sectional view of one of ironing stage of another embodiment.

In FIG. 1, the inner ends of the sub paths 42 are opened on the inner face of the through-hole 34. An axial main (oil) path 21 may be formed in the knock-out 18 (see FIG. 5). In this case, ends of sub (oil) paths 23 and 25 may be opened on an outer circumferential face of the knock-out 18, which is capable of sliding on the inner face of the die 16. In FIG. 5, the sub path 25 is formed into a groove on the lower end face of the knock-out 18.

The oil mist in a hole 27 in which the spring 20 is provided is introduced into the main path 21. The oil mist is sprayed from the outer circumferential face of the knock-out 18 via the sub paths 23 and 25.

In the embodiment shown in FIG. 5, the sub path 25 is opened on the lower end face of the knock-out 18. Thus, in the state of having a clearance between the lower end face of the knock-out 18 and the upper end face of the punch 28 (see FIG. 5), the oil mist can be sprayed from the lower end of the knock-out 18, so that the oil mist can be supplied to the projecting section 7 and the upper end section of the punch 28.

When the upper member 50 is moved downward and the upper end face of the punch 28 contacts the lower end face of the knock-out 18, spraying of the oil mist is stopped. But the oil mist can be supplied from the sub paths 23 and 25, which are opened on the outer circumferential face of the knock-out 18, so that the oil can be supplied to the projecting section 7 and the upper end section of the punch 28.

When the upper end section of the punch 28 enters the die 16, pushes the knock-out 18 upward against the elasticity of the spring 20, and irons the projecting section 7, the machining oil can be supplied to the projected section 7 and the tapered section 36 from the sub paths 23 and 25. With this structure, the ironing efficiency can be raised.

Figure 12:
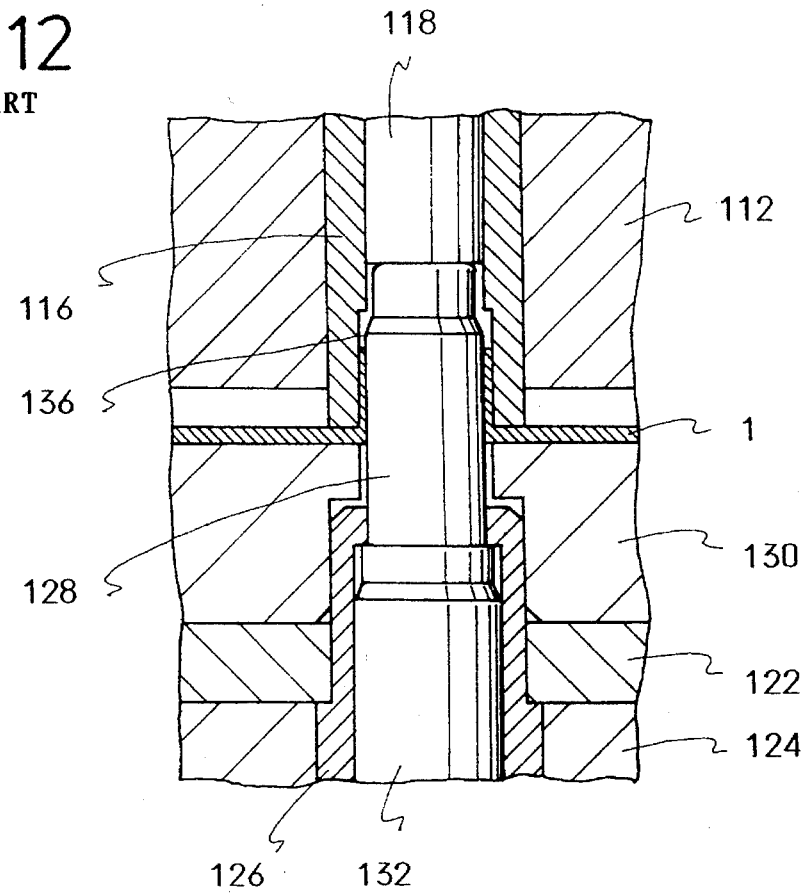
FIG.12 PRIOR ART
FIG. 12 is a partial enlarged sectional view of the ironing stage shown in FIG. 11.

When the tapered section 36 of the punch 28 passes the projected section 7, the ironing is completed (see FIG. 12). Then the upper member 50 is moved upward, so that the upper end section of the punch 28 comes off from the die 16. During the movement, the knock-out 18, whose lower end face contacts the upper end face of the punch 28, slides downward in the die 16. By the downward movement of the knock-out 18, the collar, which has been stuck on the inner face of the die 16, is ejected from the die 16.

Figure 6:
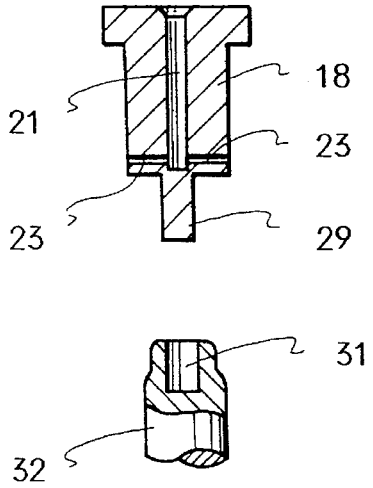
FIG. 6 is a sectional view showing another example of the knock-out.
Figure 7:
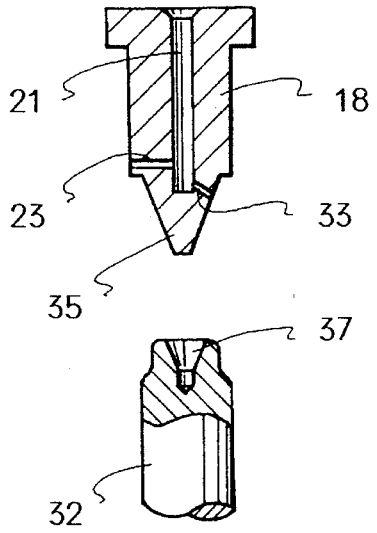
FIG. 7 is a sectional view showing another example of the knock-out.

In FIG. 5, the knock-out 18 has a flat lower end face but the knock-out 18 shown in FIG. 6 or 7 may be used.

In FIG. 6, there is formed a columnar projected section 29 on the lower end face of the knock-out 18. On the other hand, there is formed a concave section 31 in which the projecting section 29 can be fitted on the upper end face of the punch 32. One main path 21 and four sub paths 23, which radially extend from the main path 21, are formed in the knock-out 18. Ends of the sub paths 23 are opened on the outer circumferential face of the knock-out 18.

In FIG. 7, there is formed a conical projecting section 35 on the lower end face of the knock-out 18. On the other hand, there is formed a concave section 37 in which the projecting section 35 can be fitted on the upper end face of the punch 32. One main path 21 and two sub paths 23 and 33 are formed in the knock-out 18. An end of the sub path 23 is opened on the outer circumferential face of the knock-out 18; an end of the sub path 33 is opened on outer circumferential face of the projecting section 35.

In the knock-out 18 shown in FIG. 6 or 7, since the projecting section 29 or 35 can be fitted in the concave section 31 or 37, the positioning accuracy of the punch 32 can be increased.

Figure 8:
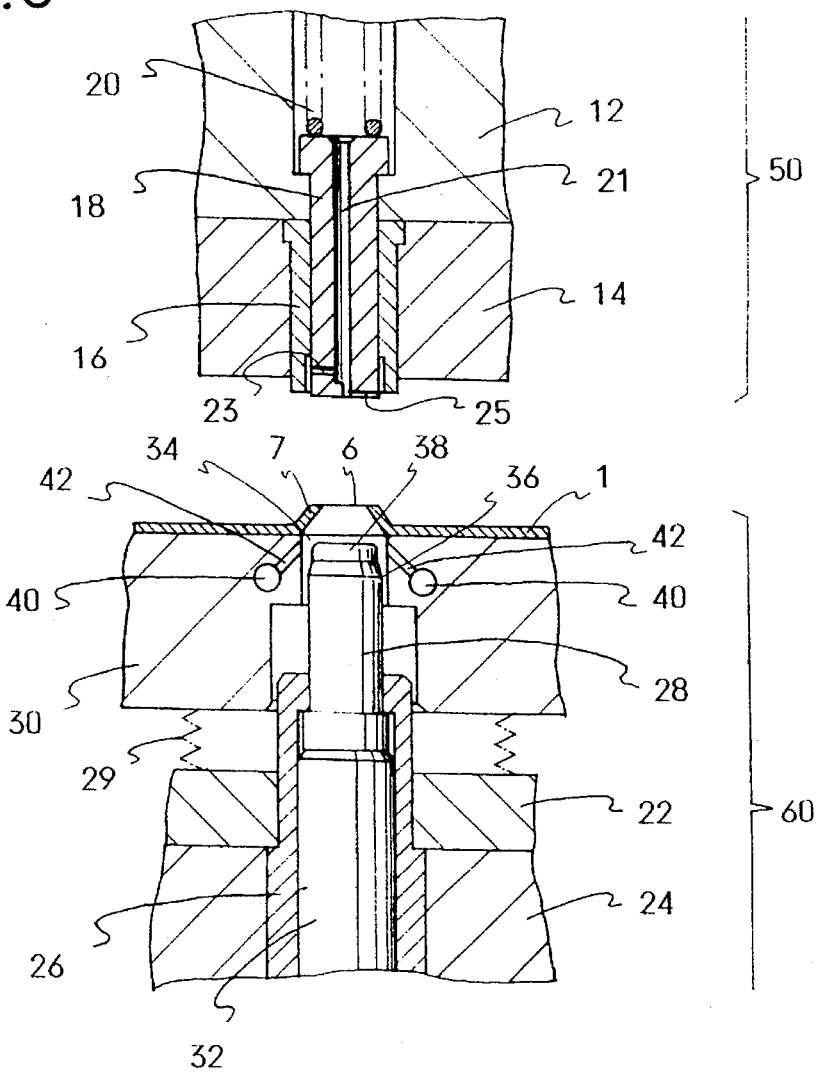
FIG. 8 is a longitudinal partial sectional view of one of ironing stage of another embodiment.

In the stage 108 shown in FIGS. 1 and 5, the oil paths for spraying the oil mist are formed in the stripper plate 30 or the knock-out 18. The oil paths may be formed in the stripper plate 30 and the knock-out 18 as shown in FIG. 8. With this structure, the ironing efficiency can be further raised.

In FIG. 8, there is formed first main (oil) paths 40 and the sub paths 42 are formed in the stripper plate 30. The machining oil can be sprayed in the through-hole 34 from the sub paths 42. On the other hand, there is formed a second main (oil) path 21 and the sub paths 23 and 25 are formed in the knock-out 18. The machining oil can also be sprayed from the sub paths 23 and 25. The structures of the stripper plate 30 and the knock-out 18 are the same as that shown in FIGS. 1 and 5. Note that, in the case shown in FIG. 8, a set of a first oil path has the main path 40 and the sub paths 42; a set of a second oil path has the main path 21 and the sub paths 23 and 25.

The machining oil can be spirally sprayed into the through-hole 34 from the sub paths 42 of the stripper plate 30; the machining oil also can be sprayed from the sub paths 23 and 25 of the knock-out 18. With this structure, the machining oil can be supplied to the upper end section of the punch 28 and the projecting section 7 of the metal plate 1.

The projecting section 7 of the metal plate 1 is ironed by the punch 28 as shown in FIG. 8. During the ironing, the machining oil, which has been introduced to the first main paths 40, is sprayed into the through-hole 34 from the sub paths 42, and another machining oil is sprayed from the sub paths 23 and 25 of the knock-out 18, so that the machining oil can be directly supplied to the inner part of the projected section 7 and the upper end section of the punch 28 including the tapered section 36.

When the upper die 50 is moved downward, the stripper plate 30 is pushed downward by the lower end face of the die 16, so that the distance between the stripper plate 30 and the plate 22 is shortened. With the movement, the upper end section of the punch 28 projects upward from the upper face of the stripper plate 30. When the upper die 50 is further moved downward, the upper end section of the punch 28, which projects from the upper face of the stripper plate 30, passes through the hole 6 and comes into the die 16. Upon coming into the die 16, the punch 28 pushes the knock-out 18 upward against the elasticity of the spring 20. With the movement of the punch 28, the projecting section 7 is ironed by the punch 28 and the inner face of the die 16. The ironing is executed until the tapered section 36 of the punch 28 passes the projecting section 7.

In the present embodiment, the machining oil can be sprayed from the sub paths 23, 25 and 42 while the ironing is executed. Therefore, the machining efficiency can be raised.

The ironing stage 108 is shown in FIGS. 1 and 8 but other stages for the manufacturing steps shown in FIG. 9A–9F also have the stripper plates, so the oil paths including the main paths and the sub paths for supplying the machining oil can be formed in the stripper plates. In this case, the machining oil can be effectively supplied to other stages like the stage 108.

In the embodiments shown in FIGS. 1, 5 and 8, the punch 28 is fixed to the lower member 60 but it may be fixed to the upper member 50, which is capable of vertically moving. In this case, the stripper plate 30 may be fixed to the upper member 50 or the lower member 60.

Figure 13:
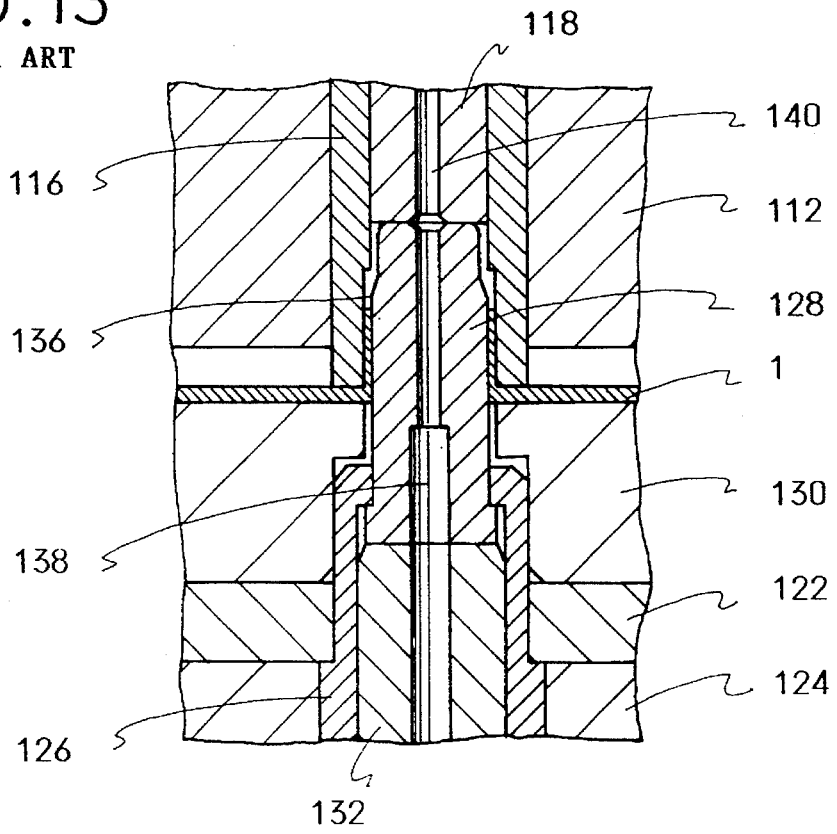
FIG.13 PRIOR ART
FIG. 13 is a partial enlarged sectional view of another conventional ironing stage.

Furthermore, the oil paths may be formed in the punch 28 and the knock-out 18 as shown in FIG. 13.

In the above embodiments, the die-punch machines for manufacturing the radiating fins have been described but the present invention can be employed to die-punch machines for boring through-holes in workpieces other than metal plates.

Since the machining oil can be supplied to parts to which the machining oil is required to supply, the oil consumption can be reduced, so that the cost for press machining can be reduced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A die-punch machine, comprising:

a punch;

a first member for holding said punch;

a second member being capable of relatively moving to and away from said first member;

a die being held by said second member, wherein a front end section of said punch is capable of being inserted into said die;

a stripper plate being provided between said first member and said second member, said stripper plate being connected to said first member, and having a clearance thereto and a through-hole, wherein said clearance is shortened, and said front end section of said punch projects from a face of said stripper plate, which is on said second member side, through the through-hole so as to go into said die when said first member and said second member mutually get close; and an oil path for introducing a machine oil being formed in said stripper plate, one end of said oil path being opened on an inner face of the through-hole.

2. The die-punch machine according to claim 1, wherein said oil path has a main path and a sub path, which is branched off from said main path, and one end of said sub path is opened on said inner face of the through-hole.

3. The die-punch machine according to claim 1, wherein the one end of said oil path is opened to face said center of the through-hole.

4. The die-punch machine according to claim 1, wherein the one end of said oil path is opened to face a position shifted from said center of the through-hole.

5. The die-punch machine according to claim 1, wherein there are provided a pair of said oil paths on both sides of the through-hole, and the one ends of said oil paths are opened on the inner face of the through-hole.

6. The die-punch machine according to claim 2, wherein a plurality of the sub paths are formed so as to uniformly supply the machine oil in the through-hole.

7. The die-punch machine according to claim 1, further comprising a biasing member, which always biases said stripper plate toward said second member.

8. A die-punch machine, comprising:

a punch a first member for holding said punch;

a second member being capable of relatively moving to and away from said first member;

a die being held by said second member, wherein a front end section of said punch is capable of inserting into said die;

an ejecting member for ejecting a workpiece, which is stuck on an inner face of said die, when the front end section of said punch comes off from said die, an outer circumferential face of said ejecting member being capable of sliding on the inner face of said die, said ejecting member capable of contacting an end face of said punch in said die whereby said ejecting member is moved with the movement of said punch; and an oil path of introducing a machine oil being formed in said ejecting member, one end of said oil path being opended on the outer circumferential face of said ejecting member, said oil path includes a main path and a sub-path, which is branched off from said main path, and one end of said sub-path is opened on said outer circumferential face of said ejecting member, said end of said oil path is opened on an end face of said ejecting member, which is capable of contacting said end face of said punch.

9. The die-punch machine according to claim 8, wherein said first member is fixed, said second member being capable of moving to and away from said first member, and said ejecting member is always biased toward said first member by a biasing member.

10. The die-punch machine according to claim 8, wherein a concave section is formed on an end face of said punch, and a projecting section, which is capable of fitting into said concave section for positioning said punch, is formed on an end face of said ejecting member.

11. A die-punch machine, comprising:

a punch;

a first member for holding said punch;

a second member being capable of relatively moving to and away from said first member;

a die being held by said second member, wherein a front end section of said punch is capable of being inserting into said die;

a stripper plate being provided between said first member and said second member, said stripper plate being connected to said first member, and having a clearance thereto and a through-hole, wherein said clearance is shortened, and the front end section of said punch projects from a face of said stripper plate, which is on said second member side, through the through-hole so as to go into said die when said first member and said second member mutually get close;

an ejecting member for ejecting a workpiece, which is stuck on an inner face of said die, when the front end of said punch comes off from said die, an outer circumferential face of said ejecting member being capable of sliding on the inner face of said die, said ejecting member being capable of contacting the end face of said punch in said die whereby said ejecting member is moved with the movement of said punch;

a first oil path for introducing machine oil being formed in said stripper plate, one end of said first oil path being opened on an inner face of the through-hole; and a second oil path for introducing machine oil being formed in said ejecting member, one end of said second oil path being opened on the outer circumferential face of said ejecting member.

12. The die-punch machine according to claim 11, wherein said first oil path and said second oil path respectively have a main path and a sub-path, which is branched off from said main path.

13. The die-punch machine according to claim 11, wherein the one end of said first oil path is opened to face the center of the through-hole.

14. The die-punch machine according to claim 11, wherein the one end of said first oil path is opened to face a position shifted from the center of the through-hole.

15. The die-punch machine according to claim 12, wherein a pair of said first oil paths are provided on both sides of the through-hole, and the one ends of said sub-paths of said first oil paths are opened on the inner face of the through-hole.

16. The die-punch machine according to claim 15, wherein the one ends of said sub-paths of said first oil paths are symmetrically located with respect to the through-hole.

17. The die-punch machine according to claim 11, further comprising a first biasing member, which always biases said stripper plate toward said second member.

18. The die-punch machine according to claim 11, wherein said first member is fixed, said second member is capable of moving to and away from said first member, and said ejecting member is always biased toward said first member by a second biasing member.

19. The die-punch machine according to claim 11, wherein the one end of said second oil path is opened on an end face of said ejecting member, which is capable of contacting the end face of said punch.

20. The die-punch machine according to claim 11, wherein the one end of said second oil path is opened in a groove, which is formed on an end face of said ejecting member, which is capable of contacting the end face of said punch.

21. The die-punch machine according to claim 11, wherein a concave section is formed on an end face of said punch, and a projected section, which is capable of fitting into said concave section for positioning said punch, is formed on an end face of said ejecting member.

22. A die-punch machine, comprising:

a punch;

a first member for holding said punch;

a second member being capable of relatively moving to and away from said first member;

a die being held by said second member, wherein a front end section of said punch is capable of inserting into said die;

an ejecting member for ejecting a workpiece, which is stuck on an inner face of said die, when the front end section of said punch comes off from said die, an outer circumferential face of said ejecting member being capable of sliding on the inner face of said die, said ejecting member being capable of contacting an end face of said punch in said die whereby said ejecting member is moved with the movement of said punch; and an oil path for introducing a machine oil being formed in said ejecting member, one end of said oil path being opened on the outer circumferential face of said ejecting member, said one end of said oil path is opened in a groove, which is formed on an end face of said ejecting member, which is capable of contacting the end face of said punch.

* * * * *